US006131731A

United States Patent [19]

Wooley

[11] Patent Number: 6,131,731

[45] **Date of Patent: *Oct. 17, 2000**

[54] SINGLE-USE GERMICIDAL MOP HEAD AND METHOD OF MANUFACTURE THEREOF

[75] Inventor: Deborah M. Wooley, Birmingham, Ala.

[73] Assignee: Deka Medical, Incorporated, Columbus, Miss.

[ * ] Notice: This patent issued on a continued prosecution application filed under 37 CFR 1.53(d), and is subject to the twenty year patent term provisions of 35 U.S.C. 154(a)(2).

[21] Appl. No.: 09/070,582

[22] Filed: Apr. 30, 1998

[51] Int. Cl.[7] ..... B65D 81/24

[52] U.S. Cl. ..... 206/207; 206/15.2; 206/362.3; 15/104.94; 15/229.2

[58] Field of Search ..... 206/205, 207, 206/209, 209.1, 361, 362.2, 362.3, 15.2, 15.3, 204; 150/154; 15/104.94, 144.2, 145, 231, 229.2, 229.6, 247

[56] References Cited

U.S. PATENT DOCUMENTS

| | | | |
|---|---|---|---|
| 1,964,025 | 6/1934 | Barton | 206/362.3 |
| 3,362,037 | 1/1968 | Griffin | 15/229.6 |
| 3,447,181 | 6/1969 | Coker et al. | 206/361 |
| 3,760,450 | 9/1973 | Griffin et al. | 15/229.6 |
| 3,817,004 | 6/1974 | Moss | 15/229.2 |
| 3,827,100 | 8/1974 | Griffin et al. | 15/229.2 |
| 4,423,811 | 1/1984 | Knapp | 206/362.3 |
| 4,940,139 | 7/1990 | Sandt | 206/362.2 |
| 4,998,984 | 3/1991 | McClendon | 206/205 |
| 5,139,142 | 8/1992 | Simon | 206/362.4 |
| 5,566,820 | 10/1996 | Deaton | 206/362.4 |

*Primary Examiner*—Paul T. Sewell
*Assistant Examiner*—Luan K. Bui
*Attorney, Agent, or Firm*—Thompson & Knight, L.L.P.

[57] ABSTRACT

The present invention provides a germicidal mop head and a method of manufacturing the same. In one embodiment, the mop head includes: (1) absorbent material capable of retaining a germicide, (2) a predetermined quantity of germicide contained in or residing on at least a portion of the absorbent material and (3) a container, located about at least a portion of the absorbent material, that retains the germicide about the germicidal mop head. The present invention therefore introduces a (preferably single-use and disposable) mop head that is germicide-impregnated for convenience and efficacy.

3 Claims, 2 Drawing Sheets

SINGLE-USE GERMICIDAL MOP HEAD AND METHOD OF MANUFACTURE THEREOF

TECHNICAL FIELD OF THE INVENTION

The present invention is directed, in general, to sanitation apparatus and, more specifically, to a germicidal mop head designed for one-time use, perhaps in a medical facility, and a method of manufacturing the same.

BACKGROUND OF THE INVENTION

Medical treatment today has made vast strides over what was available at the end of the last century. As an example, children born today have an average life expectancy 30 years longer than their ancestors born in the same decade last century. Much of this increased longevity can be attributed to improved health care, including surgical techniques of modern medicine and the sanitary methods employed in hospitals today.

Because of the very nature of hospitals, i.e. concentrating sick people in one location, preventing the spread of infectious diseases is a major challenge. Some of the most virulent strains of staphylococcus are most commonly found in hospitals. One of the areas of greatest concern is the modern operating room (OR). In this environment, any infection present may be contracted by a patient and potentially spread throughout a ward. More likely, however, is the spread of infection through contamination of the floor or other surfaces which must be cleaned between operations. This contamination may then be spread by the many doctors, nurses, assistants and janitorial personnel who frequent the OR. Therefore, hospitals today have instituted procedures in accordance with the Association of OR Nurses (AORN) wherein the cleaning staff thoroughly cleans the OR, including mopping and disinfecting the floor after each procedure. An OR nurse is responsible for ensuring that the OR meets standards of cleanliness.

The prior art method of mopping an OR floor most frequently involves the use of a cleaning and germicidal agent applied from a mop bucket with a conventional washable cotton fiber mop head, attached to a reusable mop handle. Ideally, the AORN OR floor cleaning procedure is: (a) a "clean" (new or freshly laundered) mop head is dipped once into a clean bucket containing the cleaning and germicidal liquid, (b) the mop head is supersaturated, (c) the entire OR floor is mopped and left wet, (d) the wet germicide has time to kill at least a portion of the bacteria within which the germicide comes in contact, (e) the mop head is removed from the handle and (f) the mop head is placed in the washable laundry without being physically touched by, or splashing, the cleaning staff. The goal is that the mop not be returned to the bucket once the mop has touched the contaminated floor.

In practice however, it is probably more common (than anyone would care to admit) that the mop is returned to the mop bucket after cleaning the floor. The mop and bucket then await completion of the next procedure, or are moved to the next OR, and are reused. At least one study of purchase records of hospital mop heads and laundry records shows that there was definitely not a one-to-one ratio of clean mop heads to procedures performed. This practice clearly promotes potential cross-contamination of rooms and ultimately patients.

At least four methods of attaching a cloth mop head to the mop handle are in use today. The classic mop handle has a metal or plastic stirrup through which the mop head is threaded, and the stirrup is then tightened down on the mop headband, holding the mop head in place. This mop handle is not suitable for applications in which the mop head is frequently changed. A variation of the stirrup design involves a hinged side gate on the stirrup which, when released, allows the mop head to be slid on or off of the handle. This allows for much faster changing of the mop head. A third method of attaching the mop head to the handle employs a pair of jaws which open and close over the headband and which are operated by a twist ring. The Rubbermaid Corporation manufactures a mopstick of this type under the name QUICKDROP®.

A fourth variety of handle requires a specially-constructed mop head with a male threaded bolt as the attachment mechanism. In this case, the mop handle comprises an internally threaded end to which the mating male threaded bolt in the specialty mop head is attached. Various other specialty mops with self-wringing features are also available on the market; however, they are not generally used in the medical arena due primarily to the complexity of removing/replacing the mop head. Therefore, the mops principally in use in hospital ORs are some form of the classic stirrup handle, or the QUICKDROP®, and a mop head with a bound headband.

No matter how the mop head is attached to the handle, the possibility exists that an exposed mop head will drip or spray contaminated germicide or other material on people or objects around the mop head. Employee safety is therefore a concern in handling exposed mop heads.

The most common mop head material is cotton. The mop head yarn may consist of numerous parallel pieces of yarn with cut ends bound with a central headband, i.e. a cut-end mop head. Alternatively, the mop head may be one continuous piece of yarn which is formed into parallel loops with the two yarn ends bound under a central headband, i.e. a loop-end mop head. One variation of the traditional free-end mop head is the web foot (fantail) mop head. In this embodiment, a tailband is attached distal from the headband and one to two inches from the end of the mop yarn. This spreads the yarn into a fantail, and reduces tangling and fraying of the yarn when the mop head is laundered. This variation enjoys popularity with some hospitals. Although the yarn mop is the most common, some mop heads today are made of a flat cloth-like or chamois-like material.

Although this method of cleaning OR floors has obviously been widely used, several problems with the procedure are evident. First, laundry of the mop head is dependent upon the mop head being placed in the washable laundry. This is not a 100% certain occurrence, as the cleaning staff may forget and leave the mop in the bucket when it is placed in the janitorial closet (referred to as the hopper room), opening the possibility of cross-contamination. Second, the applied germicidal mixture is dependent upon the cleaning staff properly mixing the concentrate and water. Because of the strong odor of the mixture, experience has shown that the cleaning staff does not always mix the germicide at the full recommended concentration. Third, the contaminated mop can very easily be reused in the same or another OR, creating cross-contamination. Fourth, the contaminated mop head must be stored until it is taken to the laundry, again opening the possibility of cross-contamination. Fifth, when the mop head is removed the cleaning staff must handle the contaminated mop head to remove it from the stirrup, introducing a chance of contaminating the cleaning staff. Sixth, mop heads made from cut end yarn, although cheaper than loop-end yarn, tend to fray, unravel, and shed lint. Lint is particularly undesirable because it may act as an airborne vector thereby transmitting bacteria residing upon it. Seventh, cut end yarn holds less liquid and has significantly shorter useable life than loop-end yarn. Eighth, laundering is expensive.

From an economic standpoint, the classic yarn mop heads are a significant expense. In addition to acquisition cost (and the added acquisition cost of attendant hardware, such as mop buckets, wringers and the like), there is the continuing cost of laundering the mop heads. The purchase cost of a reusable mop head is approximately $10. When combined with the cost of laundering the mop head (approximately $4.00 per wash), and the estimated useable life expectancy of a mop head (ten washings), the average cost per procedure of just the mop head is approximately $5. When multiplied times an estimated 100 procedures per day with 20 work days per month, an average hospital thus incurs an overhead cost on the order of $10,000 per month just for cleaning OR floors. Also, the mop heads are a reusable supply item which requires inventory control. Significantly, since the washable mop heads can be reused and are not issued for a specific OR procedure, the mop heads are an overhead expense to the hospital and cannot be charged to a particular patient. If the mop heads are disposable after one use, they may be allocated against a specific procedure and patient, and the cost of the item thus passed on to the patient.

Accordingly, what is needed in the art is a single use germicidal mop head which can be detached from the mop handle without contaminating the janitorial staff. Further, what is needed in the art is a cleaning system that does not rely on buckets or other attendant hardware.

SUMMARY OF THE INVENTION

To address the above-discussed deficiencies of the prior art, the present invention provides a germicidal mop head and a method of manufacturing the same. In one embodiment, the mop head includes: (1) absorbent material capable of retaining a germicide, (2) a predetermined quantity of germicide contained in or residing on at least a portion of the absorbent material and (3) a container, located about at least a portion of the absorbent material, that retains the germicide about the germicidal mop head.

The present invention therefore introduces a (preferably single-use and disposable) mop head that is germicide-impregnated for convenience, safety and efficacy.

In one embodiment of the present invention, the absorbent material is composed of a plurality of fiber pieces selected from the group consisting of: (1) cotton and (2) RAYON®. Of course, other fibers may be employed to advantage, depending upon the desired application.

In one embodiment of the present invention, the fiber pieces are formed as yarn. A plurality of parallel yarn pieces are bound with a central headband joining the plurality of yarn pieces to form a mop head having cut ends at a free end thereof.

In one embodiment of the present invention, the yarn pieces comprise cut ends which subject the yarn pieces to fraying during use of the mop head. Thus, the mop head may be designed intentionally to fray, effectively preventing laundering and reuse.

In one embodiment of the present invention, the mop head further comprises a tailband further joining the plurality of yarn pieces to form the yarn pieces into a fantail. Of course, such tailband is not necessary to the present invention.

In one embodiment of the present invention, the container is an impervious bag, perhaps of polyethylene or similar material. The bag is constricted about the central headband to allow the mop head to be joined to a mop handle without requiring the bag to be opened. In one embodiment to be illustrated and described, the bag is melted or sewn to the central headband and has a tearable seam proximate the central headband allowing the bag to be torn free once the central headband is joined to an appropriate mop handle.

In one embodiment of the present invention, the bag is provided with a reclosable seal (perhaps a ZIPLOC®-type seal) at an open end thereof to allow the bag to be sealed about the mop head following use. In an embodiment to be illustrated and described, the bag has a tearable seam and a reclosable seal proximate the cut ends of the mop. The tearable seam allows the mop head to be exposed for use without removing the bag from the mop head. The reclosable seal allows the bag to function in two capacities: to prevent the germicide in an unused mop head from evaporating or contacting a user's skin and to isolate a used, contaminated mop head. Of course, other containers may be employed to advantage, depending upon the desired objective.

In one embodiment of the present invention, the absorbent material is pieces of woven material, such as cotton or RAYON® cloth. In yet another embodiment, the absorbent material is pieces of nonwoven material, such as sponge or chamois.

In one embodiment of the present invention, the germicide is a liquid which impregnates the absorbent material. In yet another embodiment, the germicide is a powder which adheres to the surface of the absorbent material during storage. The powdered germicide is self-activated upon use or activated by immersion in a liquid such as water or a detergent solution. In yet another embodiment, the germicide includes a detergent, either liquid or powdered as desired.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
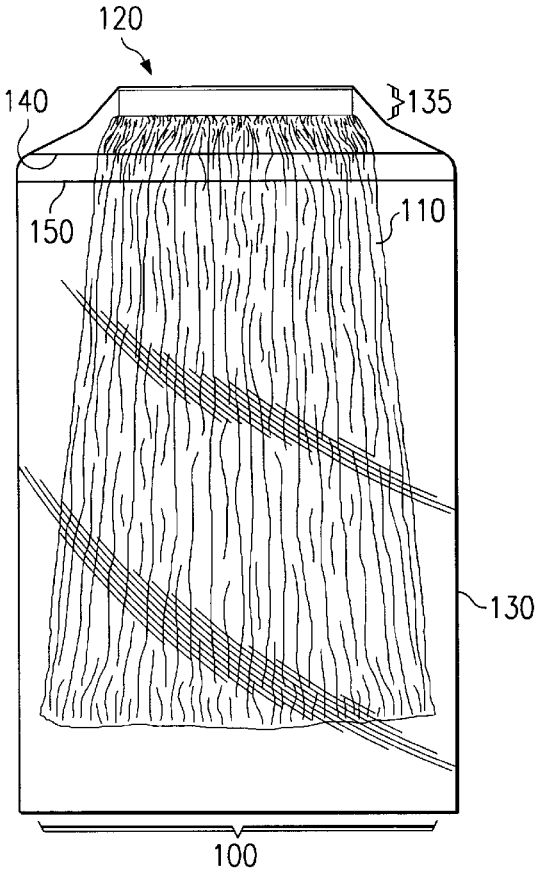
FIG. 1 illustrates one embodiment of a mop head constructed according to principles of the present invention.

Referring initially to FIG. 1, illustrated is one embodiment of a mop head constructed according to principles of the present invention. The mop head, generally designated 100, comprises absorbent material 110, a central headband 120 and a bag 130. In the illustrated embodiment, the bag 130 comprises an impervious flexible plastic material such as polyethylene. The bag 130 is physically attached to the headband 120 by such means as melting or stitching. In one embodiment, a tear line 140 and a reclosable (perhaps a ZIPLOCK®-type) seal 150 are manufactured into the bag 130. During manufacture, a predetermined quantity of germicide is impregnated within or applied to the surface of at least some of the absorbent material 110. The germicide may be in either a liquid or dry form as desired. The dry germicide may be activated upon contact with a liquid such as water or a detergent solution.

In an alternative embodiment, the dry germicide may include a detergent which is likewise activated by water. The application of germicide assures that the germicide concentration is adequate to disinfect the desired or floor area. The bag 130 serves to contain the germicide during shipping and storage, preventing evaporation of the germicide. The bag 130 may also be used as a disposal container for the contaminated mop head 100. In the preferred embodiment, the plastic material of the bag 130 is clear to permit easy identification of a soiled mop head versus an unused mop head 100.

In the illustrated embodiment, the bag 130 is constricted (clamping area 135) about the headband 120 to allow the mop head 100 to be joined to a mop handle without requiring the bag 130 to be opened. In this embodiment, a clamping-type mop handle (perhaps a Rubbermaid QUICKDROP®) is applied to the headband 120 over the bag 130 at the clamping area 135. The plastic bag 130 is opened by tearing at the tear line 140 exposing the mop head 100. Thus the cleaning staff can expose the clean mop head 100 without handling the absorbent material 110 impregnated with germicide. After use, the mop head 100 may be dropped in the disposable contaminated waste or returned to the bag 130 and resealed with the reclosable seal 150.

Figure 2:
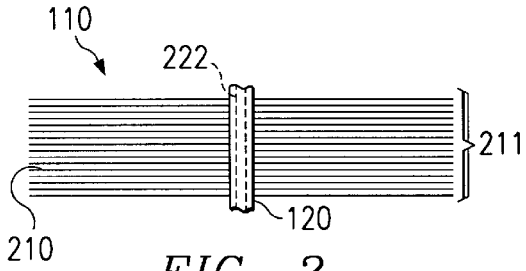
FIG. 2 illustrates the mop head of FIG. 1 during manufacture.

Referring now to FIG. 2, illustrated is the mop head of FIG. 1 during manufacture. The absorbent material 110 is a plurality of fiber pieces 210 arranged parallel to one another. In a particularly advantageous embodiment, the fiber pieces are yarn. The yarn pieces 210 may be pre-cut to the desired length or may be drawn simultaneously from a corresponding plurality of spools (not shown). A headband 120 is wrapped about the plurality of yarn pieces 210 at the desired midpoint of the mop head 100 and held in place with stitches 222. The yarn pieces 210 are cut to the desired length and the cut ends 211 are left exposed. This construction technique encourages fraying of the yarn pieces 210 should the mop head 100 be laundered or used over an extended period of time, and therefore discourages reuse of the mop head 100. In the illustrated embodiment, a predetermined quantity of germicide is impregnated within at least some of the plurality of the yarn pieces 210, and the mop head 100 is attached to and sealed within the bag 130 (see FIG. 1).

Figure 3:
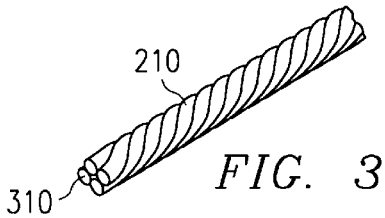
FIG. 3 illustrates an isometric view of a single piece of yarn of the mop head of FIG. 1.

Referring now to FIG. 3, illustrated is an isometric view of a single piece of yarn of the mop head of FIG. 1. The yarn 210 is formed from a plurality of fiber pieces 310 by twisting. In the illustrated embodiment, the plurality of fiber pieces 310 (herein numbering four) is composed of fibers selected from the group containing cotton and RAYON®. The choice of cotton or RAYON® fibers (or a combination of both) is made based upon the liquid pick-up, holding and release characteristics desired for the mop head 100. In an alternative embodiment, the fiber pieces 310 may be pieces of woven material such as cloth or other suitable mop material. One skilled in the art will recognize that other fibers may readily be substituted for cotton or RAYON® while remaining within the greater scope of the present invention.

Figure 4:
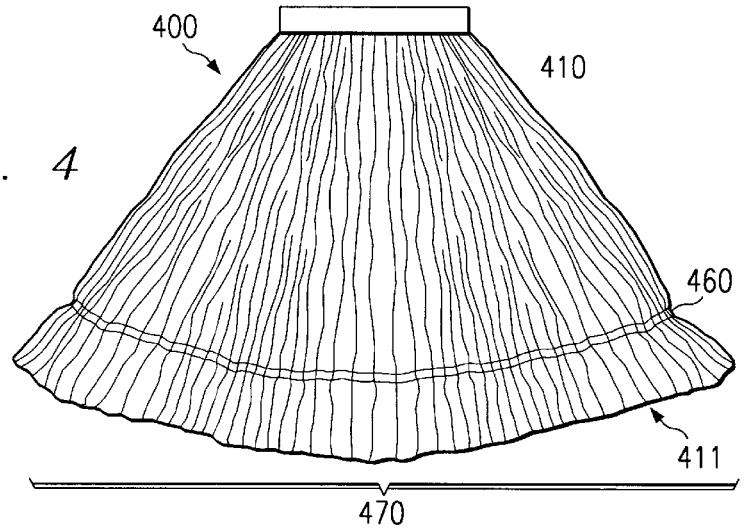
FIG. 4 illustrates one embodiment of a fantail mop head constructed according to principles of the present invention.

Referring now to FIG. 4, illustrated is one embodiment of a fantail mop head constructed according to principles of the present invention. In a fantail (also called a web foot) mop head 400, a tailband 460 is stitched in place at a location near, but short of, the cut ends 411 of the yarn 410. The tailband 460 joins the plurality of yarn pieces 410 in a spread configuration to form a fantail 470. Some customers prefer a mop head with a fantail 470, as the mop head 400 covers a larger floor area than the conventional mop head 100 of FIG. 1. However, note that the tailband 460 is located short of the free ends 411 of the yarn pieces 410, thus encouraging the yarn 410 to fray if the mop head 400 is subjected to laundering or reuse. As stated above, this construction technique of exposing cut ends 411 of the yarn 410 discourages reuse of the mop head 400.

Figure 5A:
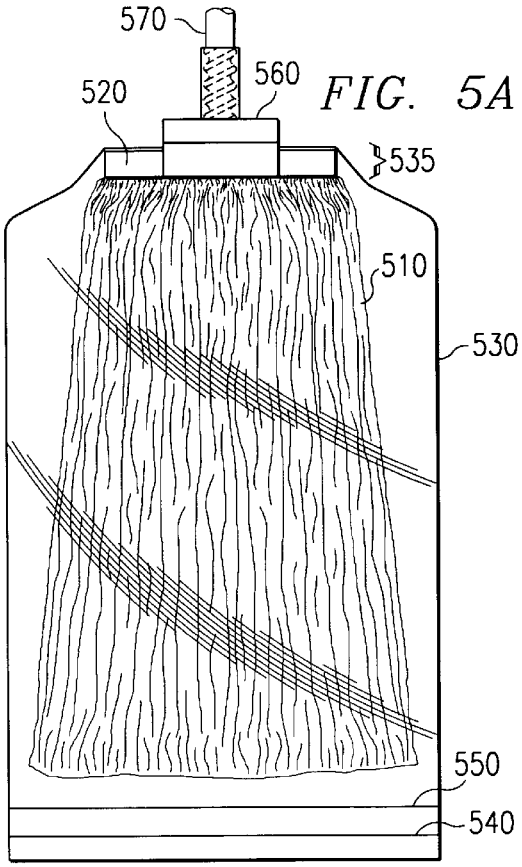
FIGS. 5A and 5B illustrate an alternative embodiment of the mop head and bag of FIG. 1.
Figure 5B:
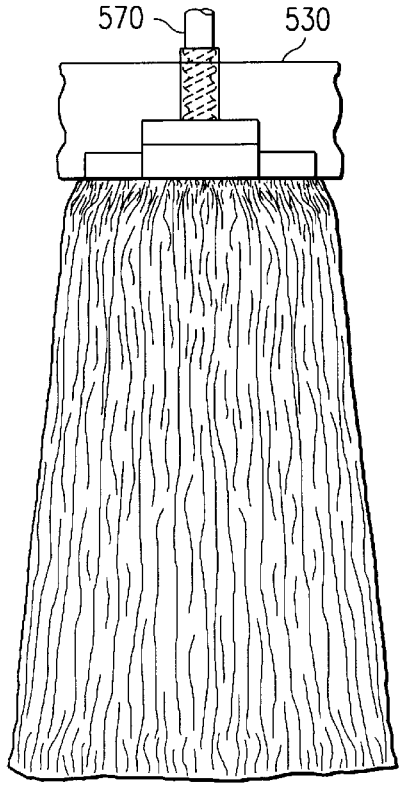

Referring now to FIGS. 5A and 5B, illustrated is an alternative embodiment of the mop head and bag of FIG. 1. As in the embodiment of FIG. 1, the bag 530 is constricted (clamping area 535) about the headband 520 to allow the mop head 500 to be gripped by clamping jaws 560. The plastic bag 530 is opened by tearing at the tear line 540. With the seal 550 open, the mop is placed in service by pulling the bag 530 from around the mop head 500 to a position circumferentially about the mop stick 570 as shown in FIG. 5B. The cleaning staff can expose the clean mop head 500 and re-cover the used mop head by handling only the clean exterior of the bag 530. When the mopping has been completed, the cleaning staff slides the bag 530 back around the mop head 500 and closes the seal 550. The attachment of the plastic bag 530 to the mop head 500 encourages resealing of a contaminated mop head and proper disposal rather than reuse.

Figure 6:
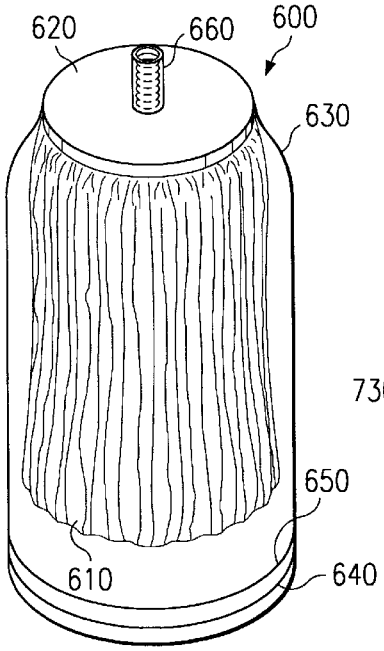
FIG. 6 illustrates an alternative embodiment of a mop head constructed according to principles of the present invention.

Referring now to FIG. 6, illustrated is an alternative embodiment of a mop head constructed according to principles of the present invention. The mop head 600 comprises nonwoven absorbent material 610, a support surface 620, a bag 630 and an attach bolt 660. The nonwoven material 610 is natural chamois or a similar man-made material. The support surface 620 may be made of any suitable material, such as metal or plastic, which will sustain storage in contact with the germicide and retain sufficient strength to perform the intended mopping task. The nonwoven material 610 is cut into a plurality of flat strips which are mechanically attached to the support surface 620 by any suitable method, such as stitching, fusing or adhesion. The nonwoven material 610 is impregnated with germicide in the manner described above and is sealed within the bag 630. Although the illustrated embodiment shows a circular support surface 620, one skilled in the art will recognize that the support surface 620 may be of any shape suitable to perform the mopping function and to facilitate manufacture. The male threaded attach bolt 660 is firmly affixed to the support surface 620 and provides the means to attach a mop handle of suitable corresponding design to the mop head 600. Surrounding the mop head 600 is an impervious bag 630 affixed to the support surface 620 and allowing the attach bolt 660 to protrude through the bag 630. The bag 630 is fused or otherwise firmly attached to the support surface 620. The bag 630 is equipped with a tear line 640 and a reclosable seal 650. The mop head 600 is placed in service in a manner similar to the mop head of FIGS. 5A and 5B. The bag 630, tear line 640 and reclosable seal 650 function in manners analogous to the bag 530, tear line 540 and reclosable seal 550, respectively, of FIGS. 5A and 5B.

Figure 7:
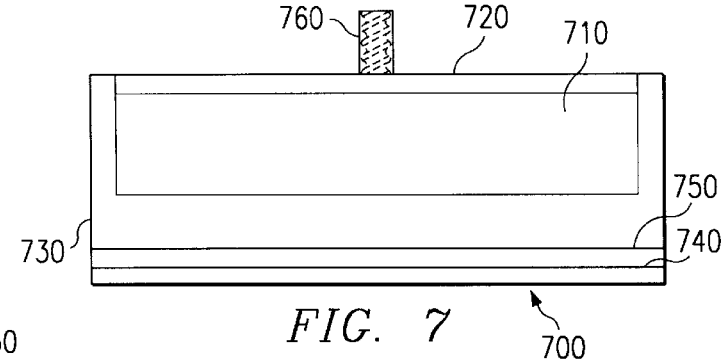
FIG. 7 illustrates one embodiment of a sponge mop head constructed according to principles of the present invention.

Referring now to FIG. 7, illustrated is one embodiment of a sponge mop head constructed according to principles of the present invention. The mop head 700 comprises absorbent material in the form of a sponge 710, a support surface 720, a bag 730 and an attach bolt 760. The sponge 710 may be of natural or man-made materials. The sponge 710 is impregnated with germicide in the manner described above and is sealed within the bag 730. The sponge 710 is mechanically attached to the support surface 720 by any suitable method such as adhesion. One skilled in the art will recognize that the support surface 720 may be of any suitable shape necessary to accommodate the sponge or may be a fixed shape for ease of manufacture. The mop head 700 is placed in service in a manner similar to the mop head 600 of FIG. 6. The bag 730, tear line 740, reclosable seal 750 and attach bolt 760 function in manners analogous to the bag 630, tear line 640, reclosable seal 650 and attach bolt 660, respectively, of FIG. 6.

Although the present invention has been described in detail, those skilled in the art should understand that they can make various changes, substitutions and alterations herein without departing from the spirit and scope of the invention in its broadest form.

What is claimed is:

1. A mop head, for applying a germicide to a surface to be mopped, comprising:

an absorbent material capable of retaining and applying a germicide to a surface to be mopped;

a predetermined quantity of germicide contained in or residing on at least a portion of said absorbent material; and an impervious container, mounted around and encapsulating at least a portion of said absorbent material, that retains said germicide about said mop head;

wherein said impervious container is provided with a reclosable seal at an open end thereof to allow said impervious container to be sealed about said mop head following use.

2. A method of manufacturing a mop head, for applying a germicide to a surface to be mopped, comprising the steps of:

forming an absorbent material capable of retaining and applying a germicide to a surface to be mopped, forming a bag with a reclosable seal at an open end thereof to allow said bag to be sealed about said mop head following use;

introducing a predetermined quantity of germicide onto at least a portion of said absorbent material; and mounting around and encapsulating at least a portion of said absorbent material with an impervious container to retain said germicide about said mop head.

3. A mop head, for applying a germicide to a surface to be mopped comprising:

a plurality of fiber pieces;

a central headband joining said plurality of fiber pieces to form a mop head having cut ends at a free end thereof;

a predetermined quantity of germicide residing on or contained in at least some of said plurality of fiber pieces; and an impervious bag, mounted around and encapsulating at least a portion of said plurality of fiber pieces, that provides an impervious container for said germicide;

wherein said impervious bag is provided with a reclosable seal at an open end thereof to allow said impervious container to be sealed about said mop head following, use.

* * * * *